US005108768A

United States Patent [19]

So

[11] Patent Number: 5,108,768

[45] Date of Patent: Apr. 28, 1992

[54] CARTRIDGE FOR BEVERAGE MAKING

[76] Inventor: Peter K. L. So, 6122 Beatrice Street, Vancouver, British Columbia, Canada, V5A 3R2

[21] Appl. No.: 275,952

[22] Filed: Nov. 25, 1988

[51] Int. Cl.[5] ..... B54D 21/02; A47J 31/00

[52] U.S. Cl. ..... 426/77; 426/112; 206/520; 206/519

[58] Field of Search ..... 426/77, 78, 79, 84, 426/86, 112; 206/217, 519, 520; 99/295

[56] References Cited

U.S. PATENT DOCUMENTS

| | | | |
|---|---|---|---|
| 1,412,388 | 4/1922 | Clermont | 426/115 |
| 1,576,735 | 3/1926 | Fessenden . | |
| 1,889,111 | 11/1932 | Serr | 206/217 |
| 2,743,664 | 5/1956 | Dale . | |
| 2,899,310 | 8/1959 | Dale . | |
| 2,915,176 | 12/1959 | O'Neill | 426/115 |
| 3,083,101 | 3/1963 | Noury | 426/77 |
| 3,387,553 | 6/1968 | Tavera . | |
| 3,445,237 | 5/1969 | Gidge . | |
| 3,446,624 | 5/1969 | Luedtke . | |
| 3,512,677 | 5/1970 | Kovac | 206/520 |
| 3,526,316 | 9/1970 | Kalogris | 426/86 |
| 3,589,272 | 6/1971 | Bouladon et al. | 426/84 |
| 3,669,001 | 6/1972 | Asen | 426/86 |
| 3,895,069 | 10/1976 | Cavalluzzi | 426/77 |
| 4,096,947 | 6/1978 | Morse | 426/86 |
| 4,124,120 | 11/1978 | Day | 206/217 |
| 4,156,483 | 5/1979 | Day | 206/217 |
| 4,368,818 | 1/1983 | Day | 206/217 |
| 4,550,024 | 10/1985 | Le Branse | 426/77 |

FOREIGN PATENT DOCUMENTS

| | | | |
|---|---|---|---|
| 622089 | 5/1936 | Fed. Rep. of Germany | 206/519 |
| 1786546 | 5/1973 | Fed. Rep. of Germany | 426/77 |
| 1214364 | 11/1958 | France | 426/77 |
| 2270161 | 1/1976 | France | 426/77 |
| 2556323 | 6/1985 | France | 426/77 |
| 606836 | 6/1960 | Italy | 206/520 |
| 1395026 | 5/1975 | United Kingdom | 206/519 |
| 2023086 | 12/1979 | United Kingdom | 206/217 |
| 2073581 | 10/1981 | United Kingdom | 206/519 |
| 2076278 | 12/1981 | United Kingdom | 206/520 |
| 2078094 | 1/1982 | United Kingdom | 206/519 |

*Primary Examiner*—Steven Weinstein
*Attorney, Agent, or Firm*—C. A. Rowley

[57] ABSTRACT

A cartridge of cup like shape having a substantially impervious frusta-conical wall provided with a first circumferential seal adjacent the open mouth of the cup and a second circumferential seal spaced toward the bottom of the cup. The bottom is perforated and is sealed by a strippable foil. The cartridge contains a preselected amount of material (say ground coffee) that fills the receptacle to a selected level. Preferably a plurality of such receptacles are packaged as telescoped stack of cartridges with a first receptacle telescoped within a second receptacle so that the second circumferential seal on the first cartridge is received in the first circumferential seal of the second receptacle thereby to seal the material in the second receptacle.

3 Claims, 3 Drawing Sheets

CARTRIDGE FOR BEVERAGE MAKING

FIELD OF THE INVENTION

The present invention relates to a cartridge. More particularly the present invention relates to a cartridge containing a selected amount of material and adapted to be telescopingly stacked to seal the contents of the cartridges.

BACKGROUND OF THE PRESENT INVENTION

Materials for making beverages such as coffee and tea are conventionally packaged in selected amounts for making one or more cups. Tea for example is packaged in perforated tea bags that are immersed in water that is substantially at boiling temperature to permit the water to permeate therethrough to brew the tea. No attempt is made to keep the individual tea bags sealed until time of use.

Coffee on the other hand is sometimes packaged in metered amounts to make one pot of coffee. The coffee preferably remains substantially vacuum packed until used by for example by providing a measured amount of coffee in a sealed pouch that is opened and emptied into say a filter basket of the conventional coffee making machine. The quantity of coffee in each pouch so packaged, as above indicated, is sufficient to make a full pot, thus if only one or two cups are desired a full pot must nevertheless be brewed.

U.S. Pat. No. 1,576,735 issued Mar. 16, 1926 to Fessenden shows a particular cartridge made out of foil or the like and having perforated sides so that liquid may infuse through the perforations and dissolve the tea or the like contained therein. As with other tea bags the quantity contained in the cartridge may be sufficient to make a single cup of tea. The shape of the cartridge controls the thickness of the mat of tea through which the water must pass in brewing a cup of tea. This patent also teaches that the cartridge may be sealed by sealing the perforations using a soluble material such as melted sugar that dissolves after immersion to open the perforations after immersion and then brewing commences.

U.S. Pat. No. 3,387,553 issued Jun. 11, 1968 to Tavera describes a particular technique for packaging coffee within a filter that forms the top of the percolator and provides a handle for handling the used grounds contained within the package. Exposure to the atmosphere of the contents of the packages is limited by packaging a plurality of such packages in a sealed container such as a coffee can. The plastic top portion of the uppermost coffee package tends to limit exposure of the lower packages in the coffee can to the atmosphere when the can has been opened.

U.S. Pat. No. 3,445,237 issued May 20, 1969 to Gidge discloses a shaped permeable cartridge adapted to fit within a conventional perforated cup of a percolator. The only sealing of the cartridges before use is the coffee can from which they are withdrawn prior to use.

U.S. Pat. No. 3,446,624 issued May 27, 1969 to Luedtke teaches the concept of a prepackaged amount of say coffee contained within a particular type of filter structure that functions to make a single cup of coffee directly within a cup by pouring the liquid through the brewing cartridge and leaving the porion of the cartridge containing the coffee immersed in the brew as long as desired.

U.S. Pat. Nos. 2,743,664 issued May 1, 1956 and 2,899,310 issued Aug. 11, 1959 both to Dale disclose frustaconical cartridge structures with a predetermined amount of coffee packaged in a compartment adjacent the bottom of the cartridge. The tapered cartridge provides a cup into which the liquid is poured to pass through the coffee in the compartment near the bottom and into a second (ordinary) cup.

None of the above provide a simple way of utilizing the cartridge structure to provide sealed container for the selected amount of material. Furthermore none of the above permit rapid dispersion of a selected amount of water through a preselect depth of material contained in the cartridge to form a preselected amount of beverage.

BRIEF DESCRIPTION OF THE PRESENT INVENTION

It is an object of the present invention to provide a self sealing cartridge structure for beverage making and a system whereby the cartridge may be directly mounted on a liquid dispenser.

Broadly the present invention relates to a cartridge comprising an open ended receptacle having circumferential side wall forming means flaring outward from a bottom wall toward an open end, passages through said bottom wall, a first circumferential sealing means formed in said circumferential side wall forming means adjacent said open end and a second circumferential sealing means formed in said circumferential wall forming means space from said first circumferential sealing means toward said bottom wall and a removable sealing means for sealing said passages through said bottom wall.

Preferably the receptacle will be filled to a preselected level with a measured amount of charge of material.

The receptacles will preferably be constructed of dimensions so that a plurality of said receptacles may be telescopingly interengaged one in the other such that a first of said receptacles is telescoped within a second of said receptacles with said first circumferential sealing means on said second receptacle receiving therein said second circumferential sealing means on said first receptacle.

BRIEF DESCRIPTION OF THE DRAWINGS

Further features objects and advantages will be apparent for the following detailed description of the preferred embodiments of the present invention taken in conjunction with the accompanying drawings, in which.

DESCRIPTION OF THE PREFERRED EMBODIMENTS

Figure 1:
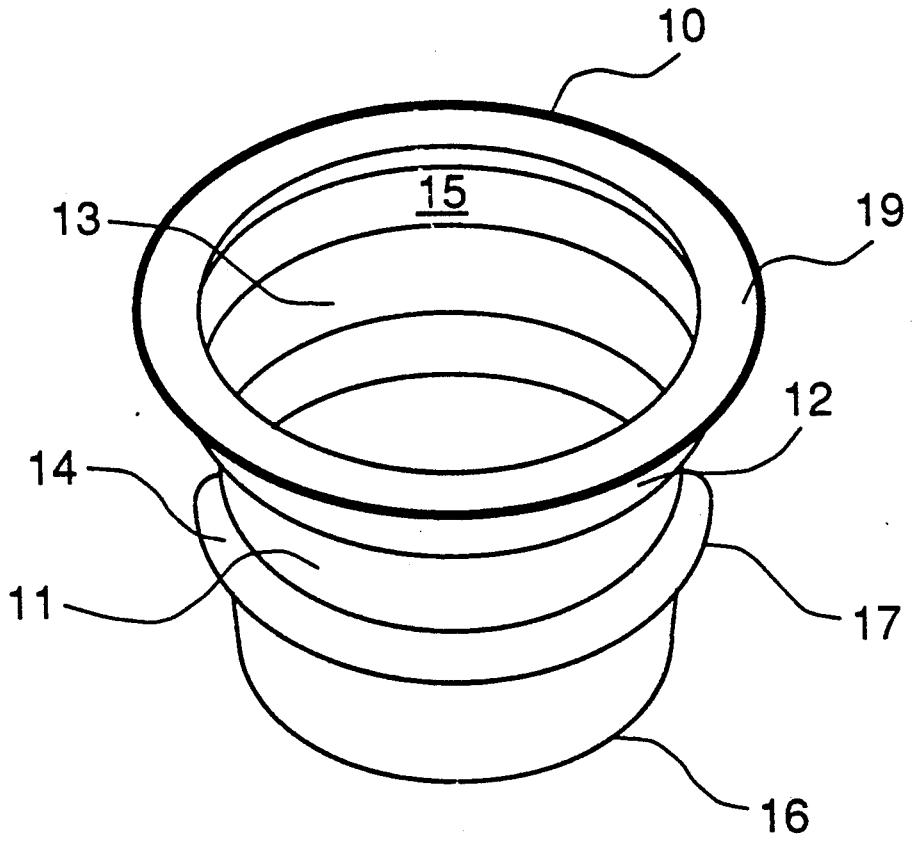
FIG. 1 illustrates embodiment of an empty cartridge constructed according to the present invention.

As shown in FIG. 1 the cartridge 10 is formed by imperforate side wall 11 made for example from a suitable plastic material and defining a substantially frusta-conical receptacle having a substantially circular cross section (other cross sectional shapes could be used), an open (top) end 13 and a bottom wall 16. The wall 11 flares outwardly from the bottom wall 16 toward the open end 13. A circumferential flange 19 may be provided around the open end or mouth 13 to provide a reinforcing and a mounting flange if desired.

First and second axially spaced circumferentially extending seal forming seats 12 and 14 respectively are formed in the wall 11 by substantially semi-circular inwardly concave and outwardly convex deformation of the shape of the wall 11. The first circumferential seat 12 is provided adjacent the open end 13 of the cartridge and has an inner concave sealing surface 15. The second circumferential seat-14 is spaced between the first seat-12 and the bottom 16 and is provided with an outer convex sealing surface 17 adapted to co-operate with the surface 15 of another nested cartridge as will be described below.

The bottom 16 of the cartridge is provided over a major portion of its area by perforations or is otherwise provided with passages 18 which preferable are substantially uniformly spaced and sized so that flow of water through the cartridge is well distributed. In the illustrated arrangement a peel back sealing cover sheet 20, made say of aluminum foil, is removably (adhesively) secured to and extends over the bottom 16 and seals the perforations 18 (see FIGS. 2 and 3.) Other means may be used to temporarily seal the passage 18, for example, if the passages 18 were X shaped the outline of the shape could be weakened and the X shape could be torn from the bottom 16 along the weakened lines thereby to simultaneously form and open the passages 18.

A charge of ground coffee or other suitable material 22 is contained within the cartridge 10 and may rest directly on the bottom 16 or a filter sheet 23 may be placed over the bottom 16 and the charge of material placed thereon. The top of the charge 22 is normally covered by a suitable retaining filter sheet or element 24.

It will be noted that the charge 22 has a substantially uniform thickness throughout its area so that the thickness or depth of material though which the liquid must pass is controlled and uniform over substantially the whole area.

Figure 2:
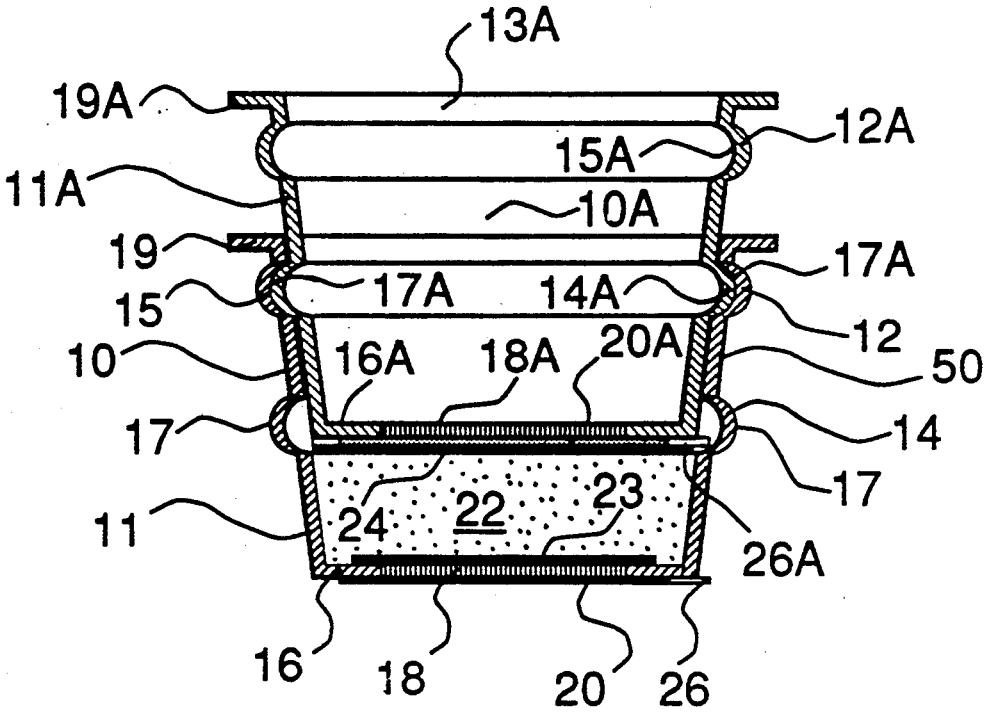
FIG. 2 is a section through a pair of telescopically interconnected cartridges of the type shown in FIG. 1.

The cartridges are intended to be sold in the form of a telescoped stack 50 of say 25 individual cartridges 10 stacked one inside the other as illustrated in FIG. 2. In the illustrated arrangement of FIG. 2 the top cartridge 10A is empty and simply functions to seal the top end of the column of cartridges. While only 2 telescoped cartridges are shown in FIG. 2 it will be apparent that any reasonable number of individual cartridges can be so arranged and all but the top cartridge filled with material 22.

The upper (first) cartridge 10A is telescopically received in the lower (second) cartridge 10 and the two cartridges are sealed together by the outer surface 17A of the seal 14A nesting into the inside of the seal forming seat-12 and co-operating with the surface 15 to provide a circumferential seal between the cartridges 10 and 10A. The perforations 18A in the bottom 16A of the cartridge 10A are sealed by the peelable sealing strip 20A which in conjunction with the circumferential seal formed by the interengagement of the seats 12 and 14A seals the material 22 in the cartridge 10 from above while the peelable seal strip 20 covering the bottom 16 of the cartridge 10 seals the material 22 in the cartridge 10 from below, thereby to completely seal the material within the cartridge 10.

A pull tab 26 may be provided on the sealing sheets 20. In the illustrated telescoping arrangement of FIG. 2 the tab 26 is accommodated in seat 14 of the cartridge immediately therebelow. The tab 26 is flexible and thus is easily deflected if necessary when the bottom cartridge is removed from the stack.

Figure 3:
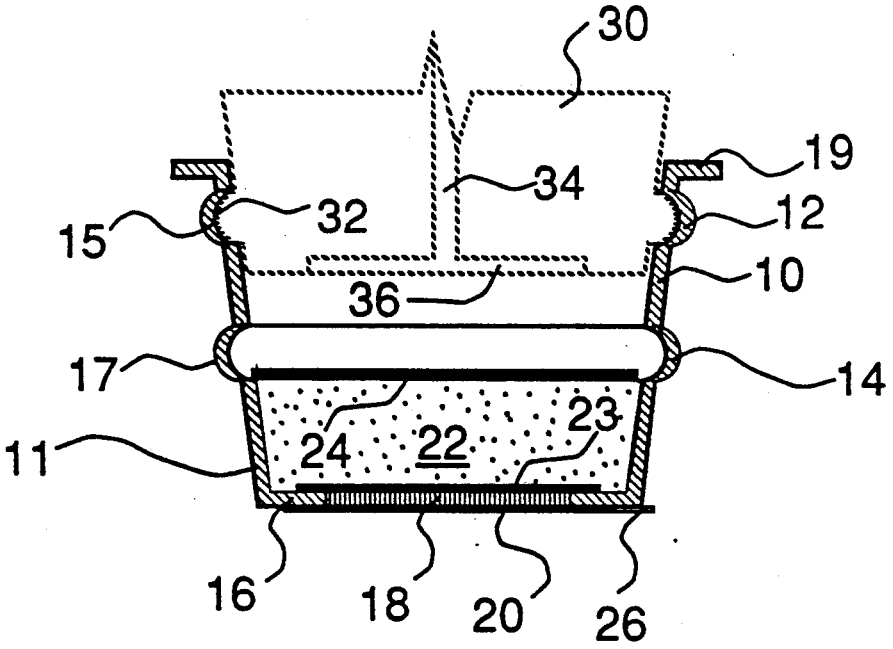
FIG. 3 is a section through a cartridge of FIG. 1 mounted on a hot water dispenser in position to make coffee (tea, etc.) once the peel back cover is removed to permit water to pass through the cartridge.

When it is desired to make a cup of, say coffee, the bottom most cartridge in this case the cartridge 10 in FIG. 2 containing a suitable charge of coffee 22 is stripped from the other cartridges in the stack 50 thereby to expose the filter 24 and then is snapped onto a suitable hot water dispenser such as is schematically indicated in dotted lines 30 in FIG. 3. Preferable the dispenser 30 will be of a special design to cooperate with the cartridge 10 and will be provided with an annular seal 32 adapted to mate with the inner sealing surface 15 of the circumferential seal forming seat-12 to secure the cartridge 10 in position. The peelable seal strip 20 may be removed before or after the cartridge 10 is mounted on the dispenser 30. Water schematically illustrated at 34 is distributed as indicated at 36, uniformly over a significant portion of the area of the filter 24 and passes from the hot water dispenser 30 through the filter 24, the material 22 and out of the cartridge 10 through the bottom filter 23 (if provided) and perforations 18 and is received in a suitable container such as a mug or cup (not shown).

If desired the water may be applied under pressure to tend to drive the liquid through the charge 22, however care must be taken to insure the pressure within the cartridge does not increase to a level that would force the cartridge from the water dispenser, i.e. break the seal formed between the surface 15 and the seal 32 and force the cartridge 10 from the dispenser 30.

Figure 4:
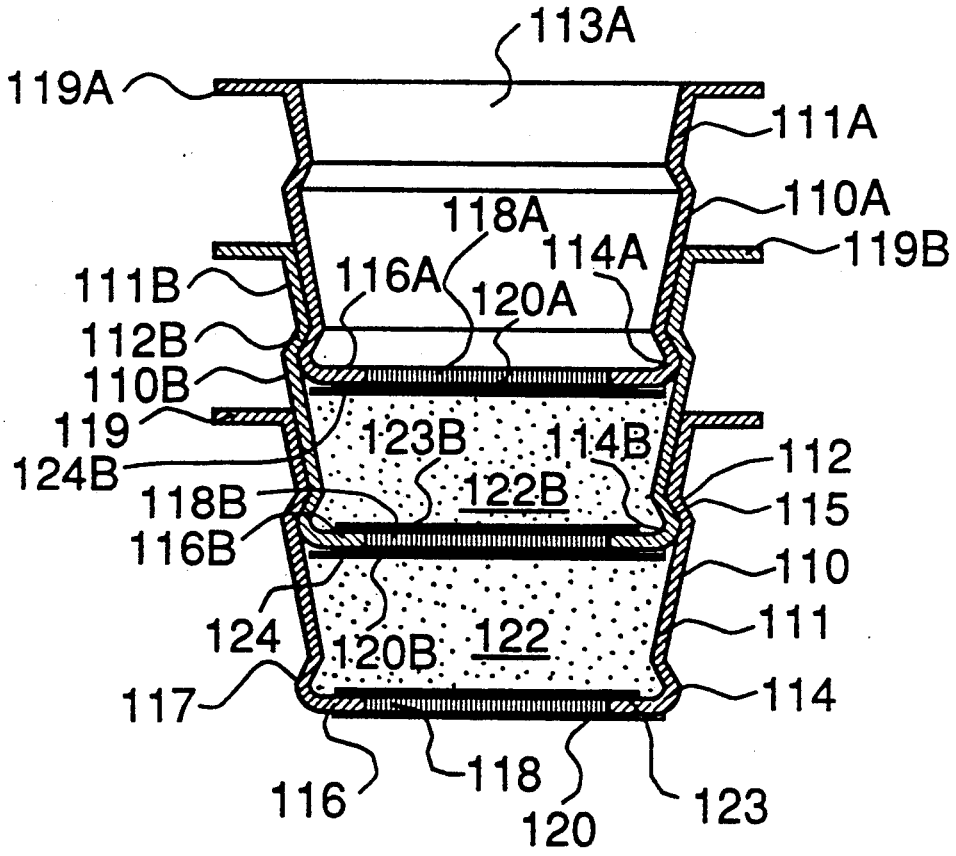
FIG. 4 is a view similar to FIG. 2 but illustrating another embodiment of the invention.
Figure 5:
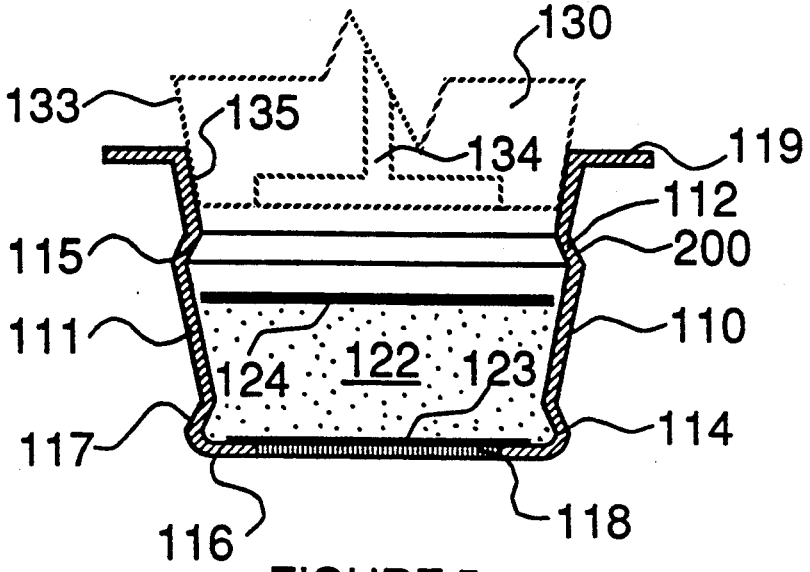
FIG. 5 is a view similar to FIG. 3 showing the cartridge of FIG. 4 mounted in position on a liquid dispenser.

The cartridge 110 illustrated in FIGS. 4 and 5 and providing a second embodiment is similar to the cartridge 10 of the first embodiment. Like parts of the cartridges 10 and 110 forming the two embodiments are represented in the drawing by the same last two digits, but with the second embodiment being further identified by the 100 series of numbers i.e. the walls 11 and 111 are equivalent but shaped differently.

As shown in FIG. 4 each cartridge 110, 110A and 110B is essentially the same and all except the top cartridge 110A is provided with its charge 122 and 122B of material (coffee) and its filters 123 and 124.

The cartridge 110 is constructed with a frusta-conical, but stepped wall 111 having an upper (first) circumferential seal forming seat-112 with an inner concave sealing surface or seat 115 formed in the step 200 in the wall 111. The lower (second) circumferential seal forming seat-114 is formed in the wall 111 at or adjacent the plane of the bottom wall 116 and has a convex outer sealing seat 117 adapted to mate with the seat 115. The bottom wall 116 is perforated as indicated at 118 and the perforations are sealed by a foil sheet 120 removably secured to the outside of the bottom wall 116. The sealing foil 120 is slightly smaller than the foil 20 and the pull tab 126 does not extend beyond the periphery of the bottom wall 116.

The cartridge 110 is used in the same manner as the cartridge 10 and may be mounted on a suitable dispenser 130 that may be provided with a seat to cooperate with the seat 115 or the flange 119 may be used to mount the cartridge. In the illustrated arrangement the dispenser 130 is provided with an outer frusta-conical surface 133 that seats in the internal frusta-conical surface 135 to prevent leakage of the liquid from the dispenser 130 flowing into the cartridge 110.

Having described the invention, modifications will be evident to those skilled in the art without departing from the spirit of the invention as defined in the appended claims.

I claim:

1. A mesting cartridge structure comprising a plurality of open ended receptacles telescopingly integrated one into another such that a first of said plurality of receptacles is telescoped within a second of said receptacles, each said receptacle having substantially impervious circumferential side wall means extending between a bottom wall at one axial end of said receptacle and an open end at the axial end of said receptacle remote from said one end, passages through said bottom wall, a first annular circumferentially extending seal forming seat in said circumferential side wall means adjacent said open end and a second annular circumferentially extending seal forming seat in said circumferential wall means spaced axially of said receptacle from said first circumferentially extending seal forming seat toward said bottom wall and a removable sealing element for sealing said passages through said bottom wall, a measured charge of material filling each said receptacle to a preset height above said bottom wall, said first circumferentially extending seal forming seat on said second receptacle receiving in sealing relationship therein said second circumferentially extending seal forming seat on said first receptacle thereby to seal said charge between said sealing element sealing said passages and a seal formed by engagement of said first and second circumferentially extending seal forming seats.

2. A nesting cartridge structure as defined in claim 1 wherein said first circumferentially extending seal forming seat having an inner concave sealing surface and said second circumferentially extending seal forming seat having an external convex sealing surface adapted to mate with said concave sealing surface.

3. A nesting cartridge structure as defined in claim 1 wherein said removable sealing element comprises an impervious sheet secured to an outer surface of said bottom wall and closing said passages.

* * * * *